United States Patent [19]

Horowitz et al.

[11] Patent Number: 4,641,898

[45] Date of Patent: Feb. 10, 1987

[54] SUPPORTING BRACKET FOR A FEMININE HYGIENE CABINET

[76] Inventors: Michael D. Horowitz; Robin M. Horowitz, both of 996 Calle Ruiz, Thousand Oaks, Calif. 91360

[21] Appl. No.: 842,811

[22] Filed: Sep. 26, 1985

Related U.S. Application Data

[63] Continuation-in-part of Ser. No. 597,499, Apr. 6, 1984, abandoned.

[51] Int. Cl.[4] ..... A47B 67/02; A47B 81/00

[52] U.S. Cl. ..... 312/209; 312/206; 312/242; 312/37; 108/50

[58] Field of Search ..... 312/209, 242, 37, 206, 312/212, 235 A, 243, 38; 108/50

[56] References Cited

U.S. PATENT DOCUMENTS

| | | | |
|---|---|---|---|
| 1,336,345 | 4/1920 | Cornelius | 312/206 |
| 2,244,833 | 6/1941 | Forman | 312/37 |
| 2,386,408 | 10/1945 | Schiff | 312/242 |
| 3,210,141 | 10/1965 | Thomas | 312/209 |
| 3,524,690 | 8/1970 | Gurney | 312/209 |
| 3,776,694 | 12/1973 | Leittl | 312/209 |
| 3,943,859 | 3/1976 | Boone | 312/242 |
| 4,002,238 | 1/1977 | Cameron et al. | 312/37 |
| 4,425,012 | 1/1984 | Kley | 312/37 |

*Primary Examiner*—Victor N. Sakran
*Attorney, Agent, or Firm*—Jack C. Munro

[57] ABSTRACT

A feminine hygiene cabinet which includes a plurality of compartments which are to contain a quantity of different types of feminine hygiene products. This cabinet is designed to be located within a conventional toilet facility and is designed to connect with a conventional toilet paper dispenser so that the cabinet will always be abuttingly located against a wall within the toilet facility regardless of variances in the installation of the toilet paper dispenser within the toilet facility.

7 Claims, 9 Drawing Figures

SUPPORTING BRACKET FOR A FEMININE HYGIENE CABINET

REFERENCE TO PRIOR APPLICATION

This application is a Continuation-in-Part of application Ser. No. 597,499, filed Apr. 6, 1984 now abandoned, entitled FEMININE HYGIENE CABINET.

BACKGROUND OF THE INVENTION

The field of this invention relates to brackets and more particularly to a bracket which has been designed in particular to support a cabinet which contains feminine hygiene products and particularly to designing of the bracket to be conveniently located at its area of use.

Within every bathroom there is located necessary hygiene articles. Normal hygiene articles are toilet paper, paper towels and within some public restrooms a sanitary napkin dispenser. However, within the normal home, there is normally not available any article for feminine hygiene such as external and internal sanitary napkins, perfume sprays, deoderants and moist towelettes.

At certain times of the month a lady can find herself in a rather compromising position as a visitor within a bathroom which does not have available these types of feminine hygiene articles. There has long been a need to construct some form of cabinet which is designed particularly to store such feminine hygiene articles and have the cabinet designed where it is readily adaptable to each and every bathroom, public or private, and can be easily and quickly mountable within that bathroom by even the most unskilled individual.

SUMMARY OF THE INVENTION

The structure of this invention is directed to a bracket to mount a cabinet which includes a plurality of compartments. Each compartment has been specifically designed to facilitate the storing of a small quantity of a particular type of feminine hygiene article, such as one compartment for external sanitary napkins, another compartment for internal sanitary napkins, another compartment for sprays, and another compartment for moist towelettes. This cabinet has been designed to be installable in any one of various manners depending on the particular desired installation for a particular bathroom. One way to install the cabinet included within this invention is to support the cabinet by a conventional toilet paper holder which is installed within every bathroom. The top of the cabinet may include an opening assembly in the side wall which defines a plurality of different mounting positions. A mounting bracket is to connect with the opening assembly at one of the mounting positions. The various mounting positions are provided to provide adjustability for each specific installation requirement. The mounting bracket includes a pair of upstanding leg members which are resiliently deflectable a slight amount so that the free end of each of the leg members is to connect with the recesses which are provided within the conventional toilet paper holder which supports the toilet paper roll supporting rod. The roll supporting rod is then located between each of the leg members after such have been installed in conjunction with the toilet paper roll dispenser.

Another embodiment of the bracket of this invention provides for a pair of support members which are to be adhesively mounted on the toilet paper holder. A pair of upstanding legs of a mounting bracket pivotally connect with these support members. The mounting bracket includes a main member connecting together these upstanding legs. The main member connects with an elongated protrusion attached to an interior surface of the top of the cabinet. The connection between the bracket and the cabinet is so the cabinet will rest flush against a bathroom wall.

The primary objective of the present invention is to mount a feminine hygiene cabinet which can be quickly and easily installed in almost any bathroom with the feminine hygiene cabinet being an attractive addition to the bathroom at the same time making available to any woman that enters the bathroom various feminine hygiene articles.

Another objective of this invention is to construct a mounting bracket for a feminine hygiene cabinet which can be manufactured relatively inexpensively and therefore sold to the consumer at a relatively inexpensive price.

DETAILED DESCRIPTION OF THE SHOWN EMBODIMENT

Figure 1:
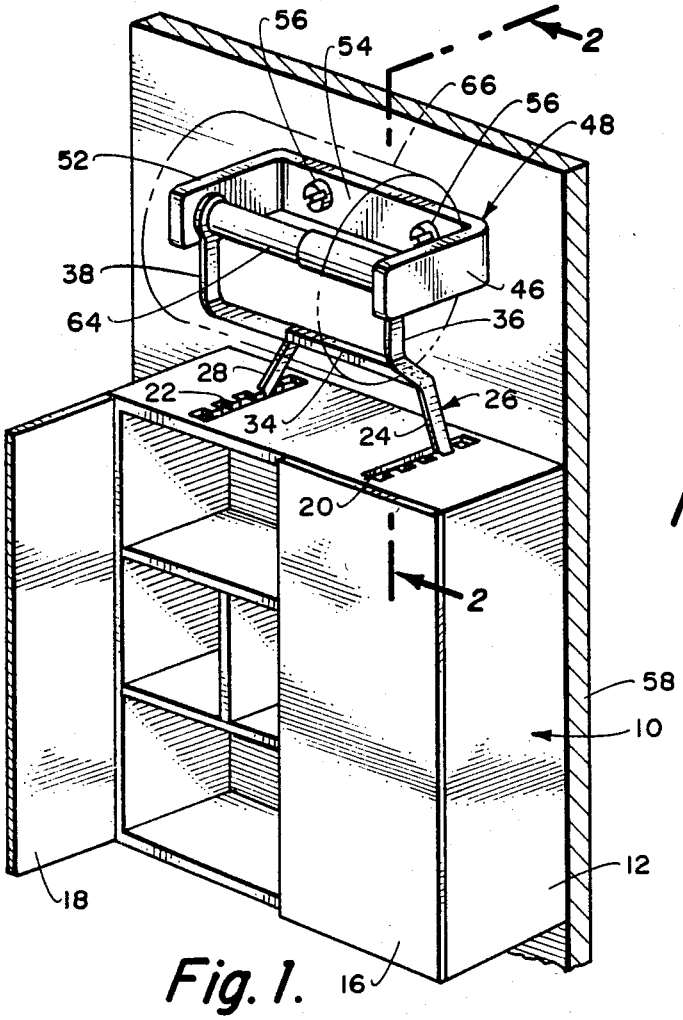
FIG. 1 is an isometric view of a feminine hygiene cabinet showing the cabinet being connected by a first embodiment of mounting bracket to a conventional toilet paper roll dispenser showing one of the doors of the cabinet in an open state so as to observe the internal compartments of the cabinet.
Figure 2:
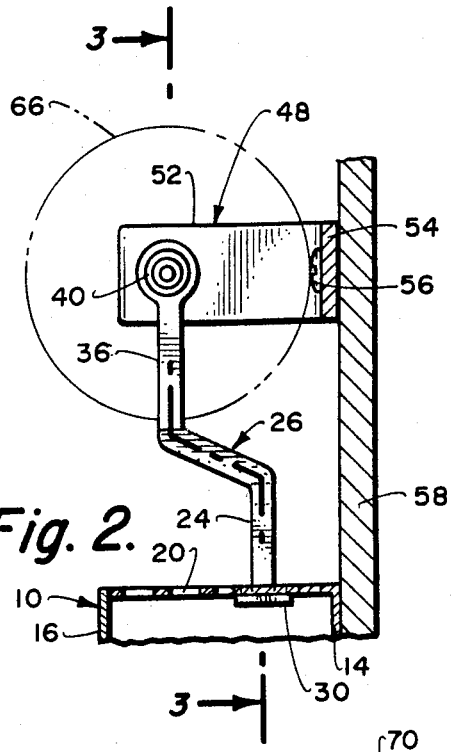
FIG. 2 is a cross-sectional view through the mounting bracket of this invention taken along line 2—2 of FIG. 1.

Referring particularly to the drawing, there is shown the cabinet 10 included within the present invention which is constructed of a basic rectangular shape having a side wall 12 located between a back wall 14 and a front wall formed of doors 16 and 18. The entire cabinet 10 is to be constructed of a sheet material such as a plastic. Although not shown in the drawing, the cabinet 10 will probably be constructed to be exteriorly ornate and/or of various color patterns. The doors 16 and 18 are hinged with respect to the side wall 12 so as to pivot freely to an open position in order to expose a plurality of interior compartments as is clearly shown in FIG. 1 of the drawing. Within these compartments is to be stored various feminine hygiene articles (not shown).

Formed within the upper surface of the side wall 10 are elongated openings 20 and 22. Each of the openings 20 and 22 include a plurality of separate recesses. The function of these recesses will be explained further on in this specification.

Opening 20 is to connect with depending leg 24 of a mounting bracket 26. Similarly, opening 22 is to connect with depending leg 28 of the mounting bracket 26. Each of the legs 24 and 28 terminate in the outwardly extending flanges 30 and 32 respectively. The upper end of the legs 24 and 28 connect to connecting member 34. It is to be understood that the entire mounting bracket 26 will normally be constructed of a plastic material which permits bending or deflecting of the depending legs 24 and 28 toward each other and when released will cause the legs 24 and 28 to be biased in an outward direction.

The legs 24 and 28 are to be physically deflected toward each other and then leg 24 inserted within opening 20 with leg 28 being inserted within opening 22. Release of the legs 24 and 28 then cause such to be biased outwardly so that leg 24 engages with one of the recesses of opening 20 and leg 28 engaging with a similar aligned recess of opening 22. As to which particular recess of the plurality of recesses of the opening 20 and 22 that the legs 24 and 28 will engage with depends on the particular installation. This will be explained in more detail further on in this specification. Cabinet 10 is supported by flange 30 integrally attached to leg 24 and flange 32 integrally attached to leg 28.

Connected to connecting member 34 at one end thereof and extending upwardly therefrom there is an upstanding leg 36. A similar upstanding leg 38 is connected to the opposite end of the connecting member 34 and extends upwardly therefrom. Member 36 is the reverse of member 38. The outer end of the member 36 is formed into an outwardly extending protuberance 40 defining an annular series of concentric steps. A similar protuberance 42 is formed with the outer end of the leg 38.

Again, the legs 36 and 38 can be slightly deflected toward each other. This deflection is necessary so as to have protuberance 40 engage with the recess 44 of wall member 46 of a bifurcated bracket 48. Similarly, the protuberance 42 is to connect with recess 50 of wall member 52 of the bracket 48. The wall members 52 and 46 are located parallel to each other and are connected together through connecting member 54. The member 54 is to be mounted by means of conventional fastening means 56 onto a conventional vertical surface such as a wall 58.

The inner surface of the protuberance 40 includes a recess 60. A similar recess 62 is formed within the inside surface of the protuberance 42. A conventional toilet paper roll supporting rod 64 is to be connected with recesses 60 and 62 and extending therebetween. A conventional toilet paper roll 66 is to be mounted on the rods 64.

The desirable form of installation of the cabinet 10 of the present invention is as follows: If the toilet paper roll mounting bracket 48 extends from the wall 58 as shown within the drawing, then the operator locates the bracket 26 as shown with wall 14 of the cabinet 10 lying flush against the wall 58. The operator has adjustability to obtain this flush type of installation in selecting which recess the depending legs 24 and 28 connect with in the openings 20 and 22. It is also noted that the bracket 26 itself is offset so that depending legs 24 and 28 are not in an in line position with respect with the upstanding legs 36 and 38. This means that the bracket 26 can be reversed if such is desired depending again upon the particular installation of the toilet paper roll mounting bracket 48. In some installations the bracket 48 may be slightly recessed within the wall 58. It is also considered in the scope of this invention that the mounting bracket 26 could assume a different shape other than which is shown in order to accommodate a greater variety of different types of installations. Bracket 48 is to support a toilet paper roll 66.

Instead of using openings 22 formed within the side wall of the cabinet 10, similar such openings 20 and 22 could be formed within flanges which are attached to the side wall 10 and extend outwardly therefrom. Also, it is considered to be within the scope of this invention that other types of connection arrangements could be utilized without departing from the scope of this invention.

Figure 4A:
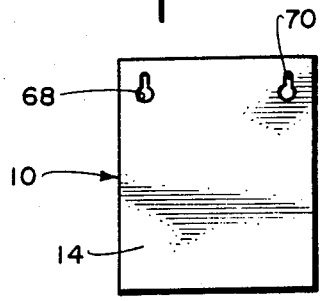
FIGS. 4*a* to 4*c* show various different types of cabinet mounting structures which could be incorporated in conjunction with the cabinet of this invention in order to provide for various types of installations depending upon individual preference.
Figure 3:
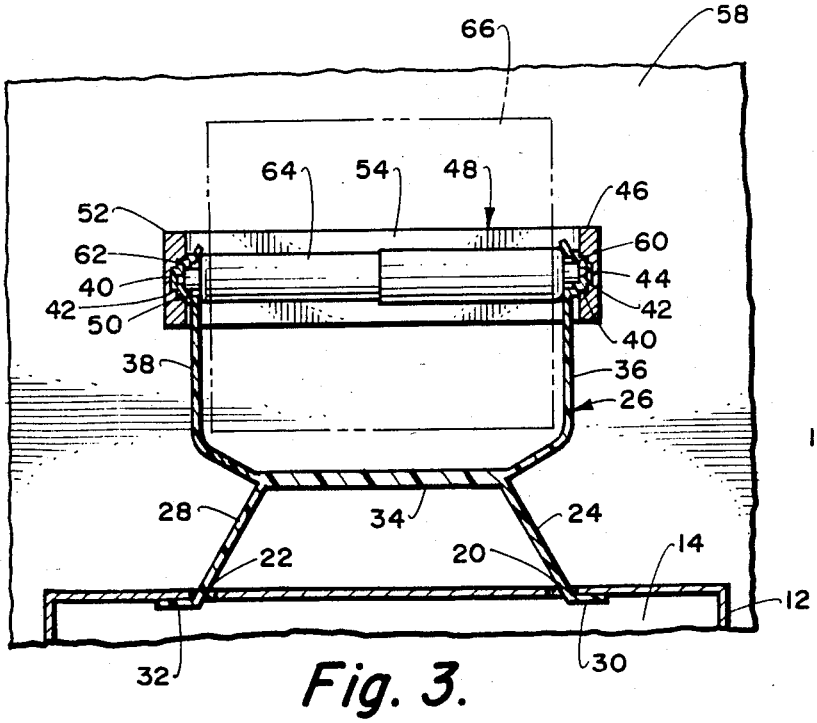
FIG. 3 is a cross-sectional view taken along line 3—3 of FIG. 2.

It is further to be considered within the scope of this invention that it may be desirable to install the cabinet 10 within the bathroom (not shown) in other manners other than connecting to the toilet paper roll supporting bracket 48. Referring particularly to FIG. 4*a*, there may be incorporated a pair of key hole slots 68 and 70 within the back wall 14. The key hole slots 68 and 70 will connect with enlarged headed fasteners (not shown) which have been mounted within the wall 58.

Figure 4B:
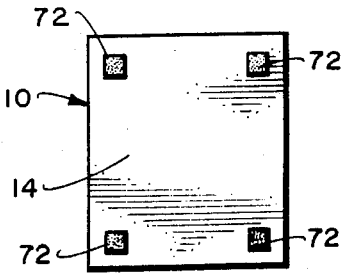

Referring particularly to FIG. 4*b*, another method of installation would be to utilize adhesive pads 72 on the back wall 14 to again secure the cabinet 10 onto the wall 58.

Figure 4C:
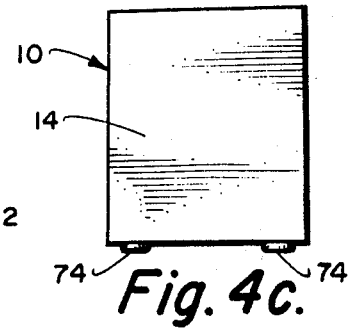

Still further, referring particularly to FIG. 4*c*, there may be incorporated within the bottom surface of the side wall 12 a plurality of feet 74 which will permit the cabinet 10 to be located in a non-slip manner on a particular object such as the floor or the top of a toilet tank.

Figure 6:
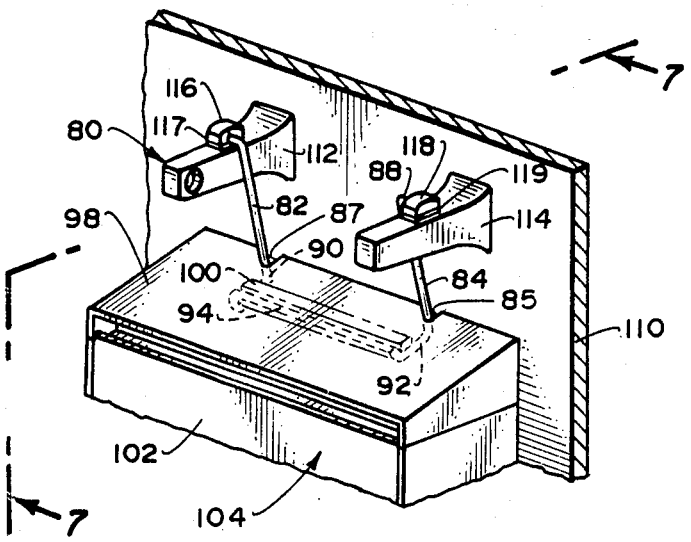
FIG. 6 is an isometric view showing a second embodiment of mounting bracket incorporated with the feminine hygiene cabinet of this invention showing the cabinet being mounted flush against a typical bathroom wall and supportingly mounted on a typical toilet paper roll holder.
Figure 7:
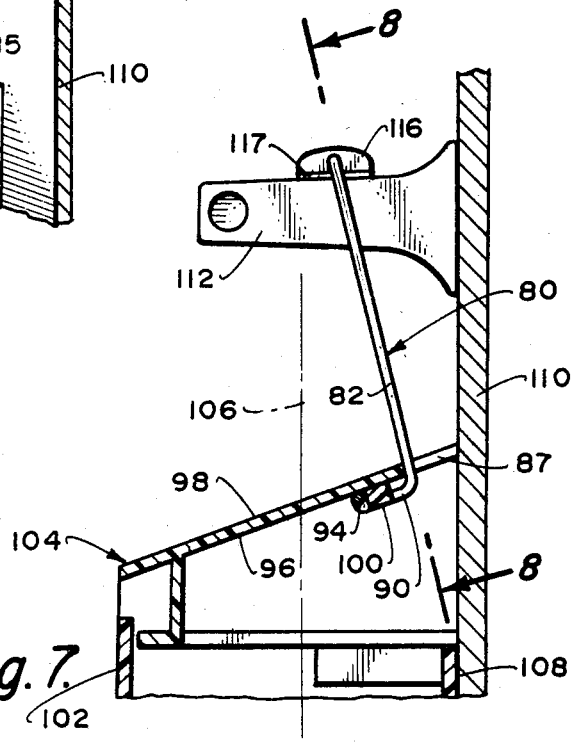
FIG. 7 is a cross-sectional view taken along line 7—7 of FIG. 6.
Figure 8:
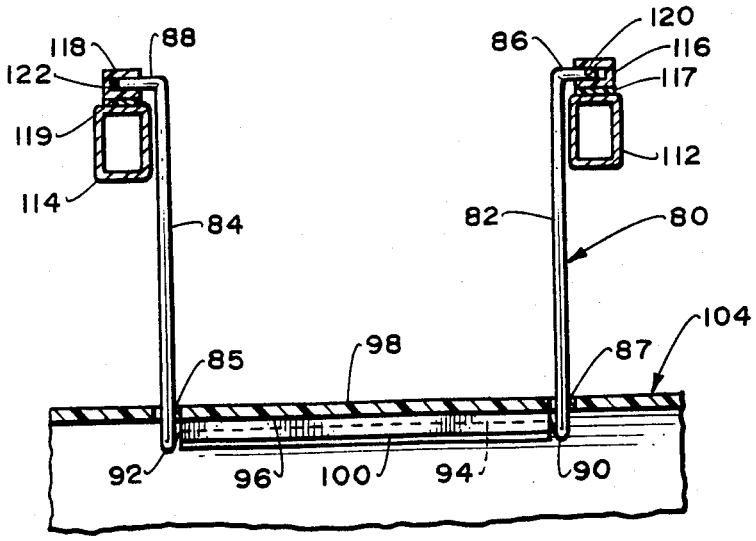
FIG. 8 is a cross-sectional view taken along line 8—8 of FIG. 7.

Referring particularly to FIGS. 6–8 of the drawings, there is shown a second embodiment 80 of the bracket of this invention, which is composed primarily of a wire member defining upstanding legs 82 and 84. The legs 82 and 84 are located in a parallel spaced-apart relationship. The free end of leg 82 is formed into outwardly extending member 86. A similarly outwardly extending member 88 is pivotally attached at the free end of the leg 84. It is to be noted that the legs 82 and 84 can be said to be located within a single plane which coincides with line 8—8 of FIG. 7.

The leg 82 at its inner end is deformed into a right angled section 90 with a similar right angled section 92 being attached to the inner end of the upstanding leg 84. Right angled sections 90 and 92 are basically identical in shape and are also parallel to each other. The outer end of the right angled sections 90 and 92 are connected together by a main member 94. The main member 94 is located parallel to the plane defined by upstanding legs 82 and 84 but is spaced slightly therefrom.

Fixedly secured to the interior surface 96 of a cabinet top 98 is an elongated protrusion 100. The length of the protrusion 100 is less than the distance between right angled sections 90 and 92 with the position of the protrusion 100 being selected to be located between the right angled sections 90 and 92. The main member 94 is to be in contact with the portion of the protrusion 100 which is nearest the front wall 102 of the feminine hygiene cabinet 104. The leg 82 connects with a slot 87 formed in top 98 and leg 84 pivotally connects with slot 85 formed in top 98. Basically the cabinet 104 includes drawers within which is to be located a quantity of feminine hygiene articles. The cabinet construction would be similar to cabinet 10.

Cabinet 104 has a center of gravity (not shown). Through the center of gravity is passed a vertical axis 106. The protrusion 100 is located between the axis 106 and the back wall 108 of the cabinet 104. This position of the protrusion 100 is important so that there will be a natural tendency for the cabinet 104, when it is in its supported position, to swing so the back wall 108 is held flush against the vertical wall structure 110. If the protrusion 100 was positioned on the opposite side of the vertical axis 106, the natural tendency would be for the cabinet 104 to assume a position spaced from the vertical wall structure 110 which would not be preferred for appearance reasons. Presumably the vertical wall structure 110 constitutes a wall within a conventional bathroom facility.

Fixedly mounted onto the vertical wall structure 110 are conventional toilet paper roll holding brackets 112 and 114. The brackets 112 and 114 are to support a conventional roll of toilet paper such as toilet paper roll 66 previously described.

Fixedly mounted such as by an adhesive strip 117 to the upper surface of 112 is a support pad 116. A similar support pad 118 is fixedly mounted onto the top surface of the bracket 114 by adhesive strip 119. Formed within the support pad 116 is a hole 120. A similar hole 122 is formed within the support pad 118. The outwardly extending end 86 is located within the hole 120 and is capable of pivotal movement in respect thereto. Similarly, the outwardly extending end 88 is mounted within the hole 122. In order to facilitate the initial insertion of the ends 86 and 88 within their respective holes 120 and 122, it is only necessary to deflect the legs 82 and 84 slightly toward each other and then insert the ends 86 and 88 within the holes 120 and 122.

The position of the pads 116 and 118 onto the respective brackets 112 and 114 is deemed to be a matter of choice since they may be located near or farther from the vertical wall structure 110. There is a natural tendency to have the vertical axis 106 to pass through the line connecting leg sections 86 and 88. However, as it is observed in FIG. 7 of the drawings, the vertical axis 106 is located spaced from this line and actually outward therefrom with respect to the wall 110. Therefore, there will be a natural tendency under the action of gravity to have the cabinet 104 to be maintained flush against the wall 110. This location of cabinet 104 is preferred as previously mentioned.

What is claimed is:

1. In combination with a toilet paper wall dispenser comprising a wall mounted bifurcated bracket having a pair of laterally extending spaced-apart wall members, a toilet paper roll supporting rod mounted on and extending between said wall members, each said wall member including hiatus means for facilitating connection with and support of an end of said rod, said rod being readily removable from said leg members, the improvement comprising:

a feminine hygiene cabinet separated into compartments adapted to contain numerous conventionally available different feminine hygiene products, said cabinet having side walls which connect a front wall and a back wall and also connect a top and a bottom, access into said compartments being through said front wall, said top including connection means; and a mounting bracket, said mounting bracket including a pair of upstanding legs, each said leg including engaging means, each said engaging means pivotally connecting with a support member with therebeing a separate said support member for each said leg, said engaging means being spaced from said hiatus means, one said support member being fixedly mounted on one said wall member and the other said support member being fixedly mounted on the other said wall member, said mounting bracket including a main member connecting together said upstanding legs, said main member connected to said connection means providing the sole support for said cabinet on said mounting bracket.

2. The combination as defined in claim 1 wherein:

said top having an interior surface and an exterior surface, said engaging means being spaced from said exterior surface, said connection means including an elongated protrusion mounted on said interior surface, said main member connecting with said elongated protrusion.

3. The combination as defined in claim 2 wherein:

said main member capable of limited pivotable movement relative to said top.

4. The combination as defined in claim 3 wherein:

said upstanding legs being located within a plane, said main member being spaced from said plane.

5. The combination as defined in claim 4 wherein:

said upstanding legs being deflectable to permit engagement and disengagement with said support members.

6. The combination as defined in claim 5 wherein:

each said support member being adhesively secured to its respective said wall member.

7. The combination as defined in claim 2 wherein:

said cabinet having a vertical axis passing through the center of gravity of said cabinet, said protrusion being located between said vertical axis and said back wall.

* * * * *